US009145013B2

(12) United States Patent
Shimura et al.

(10) Patent No.: US 9,145,013 B2
(45) Date of Patent: Sep. 29, 2015

(54) METHOD FOR PRINTING AND PRINTING SHEET USED FOR THE METHOD

(71) Applicant: CANON KABUSHIKI KAISHA, Tokyo (JP)

(72) Inventors: Norio Shimura, Yokohama (JP); Taichi Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/955,040

(22) Filed: Jul. 31, 2013

(65) Prior Publication Data

US 2014/0035987 A1 Feb. 6, 2014

(30) Foreign Application Priority Data

Jul. 31, 2012 (JP) ..... 2012-169222

(51) Int. Cl.

| | |
|---|---|
| ***B41J 29/38*** | (2006.01) |
| ***B41J 29/393*** | (2006.01) |
| ***B41J 15/00*** | (2006.01) |
| ***B41J 3/60*** | (2006.01) |
| ***B41J 11/00*** | (2006.01) |
| ***B41J 15/04*** | (2006.01) |

(52) U.S. Cl.

CPC .. *B41J 15/00* (2013.01); *B41J 3/60* (2013.01); *B41J 11/008* (2013.01); *B41J 15/04* (2013.01)

(58) Field of Classification Search

CPC ..... B41J 3/60

See application file for complete search history.

(56) References Cited

U.S. PATENT DOCUMENTS

| | | | | |
|---|---|---|---|---|
| 4,268,943 | A | 5/1981 | Watanabe et al. | |
| 4,317,270 | A | 3/1982 | Watanabe et al. | |
| 5,532,799 | A | 7/1996 | Watanabe et al. | |
| 5,915,146 | A | 6/1999 | Kusaka et al. | |
| 6,179,287 | B1 | 1/2001 | Watanabe et al. | |
| 6,240,263 | B1 | 5/2001 | Watanabe et al. | |
| 6,575,546 | B2 | 6/2003 | Matsumoto et al. | |
| 7,050,751 | B2 | 5/2006 | Watanabe et al. | |
| 2011/0279508 | A1 * | 11/2011 | Naito | 347/16 |
| 2011/0310151 | A1 * | 12/2011 | Serizawa | 347/14 |
| 2013/0088541 | A1 | 4/2013 | Naito | |
| 2013/0215448 | A1 * | 8/2013 | Gentile et al. | 358/1.13 |

FOREIGN PATENT DOCUMENTS

| | | |
|---|---|---|
| JP | H03-197140 | 8/1991 |
| JP | 2002-046260 | 2/2002 |
| JP | 2003-237157 | 8/2003 |
| JP | 4278885 | 6/2009 |
| JP | 2011-240492 | 12/2011 |
| JP | 2011-240493 | 12/2011 |

* cited by examiner

*Primary Examiner* — Shelby Fidler

(74) *Attorney, Agent, or Firm* — Fitzpatrick, Cella, Harper & Scinto

(57) ABSTRACT

A method is provided that performs, based on a schedule, the printing of a plurality of images and the print head maintenance on the first face and the second face of a continuous sheet. The method includes: sensing a unique portion unsuitable for image printing that exists on the continuous sheet; and setting a printing schedule, when the unique portion is sensed in the first face or the second face, such that an image is prevented to be printed on the unique portion and a maintenance operation of the print head is performed at a region corresponding to the unique portion on the back face of the first or second face that has the unique portion.

16 Claims, 13 Drawing Sheets

METHOD FOR PRINTING AND PRINTING SHEET USED FOR THE METHOD

BACKGROUND OF THE INVENTION

1. Field of the Invention

The present invention relates to a technique to perform the double-sided printing of a plurality of images on a continuous sheet.

2. Description of the Related Art

A continuous sheet for a printing application may include a unique portion. The unique portion is a region that is unintentionally caused in a sheet manufacture process and that is a region in which the sheet partially has a different characteristic. If an image is printed on a region including the unique portion as described above, the resultant image does not have a high quality.

Japanese Patent Laid-Open No. 2011-240493 discloses a method according to which, when a continuous sheet including a unique portion region not suitable for printing is subjected to a double-sided printing, the unique portion regions of the top face and the back face of the sheet are both intentionally prevented from being subjected to a printing process. According to this method, when a unique portion of a continuous sheet is sensed during the printing of the first face, then a prohibited region is set in the first face printing schedule and a print-prohibited region is also set in the second face printing schedule at a position corresponding to the unique portion of the first face to subsequently continue the printing process.

In the case of the apparatus according to Japanese Patent Laid-Open No. 2011-240493, a maintenance (head maintenance) schedule for a preliminary ejection required for an inkjet printing is not optimized, thus failing to provide a further improvement.

SUMMARY OF THE INVENTION

It is an objective of the present invention to provide a method of performing an optimal scheduling including a print bead maintenance to thereby suppress the entire sheet consumption amount.

Thus, the present invention is characterized in providing a method for printing a plurality of images with a print head on a first face and a second face of a continuous sheet, the method comprising: sensing a unique portion unsuitable for image printing that exists on the continuous sheet; and setting a printing schedule, when the unique portion is sensed in the first face or the second face, such that an image is prevented to be printed on the unique portion and a maintenance operation of the print head is performed at a region corresponding to the unique portion on the back face of the first or second face that has the unique portion.

According to the present invention, when a plurality of images are sequentially printed on both faces of the continuous sheet, an optimal scheduling including the print head maintenance can be performed even when the sheet includes a unique portion, thereby suppressing the entire sheet consumption amount.

Further features of the present invention will become apparent from the following description of exemplary embodiments (with reference to the attached drawings).

DESCRIPTION OF THE EMBODIMENTS

The following section will describe an embodiment of an inkjet printing apparatus. This printing apparatus is a high-speed line printer that uses a long continuous printing sheet (a continuous sheet having a length longer than the length of a printing unit repeated in a conveying direction (called as one page or a unit image)) and that can handle both of a one-sided printing and a double-sided printing. For example, this printing apparatus is suitably used in the field in which a high amount of sheets are printed in a printing laboratory for example. The term "one unit image" herein means to include a region of one print unit (one page) including a plurality of small images or characters or spaces. Specifically, a unit image means one print unit (one page) used to sequentially print a plurality of pages on a continuous sheet. The term "unit image" also may be simply called as an image instead of a unit image. The unit image has a different length depending on a to-be-printed image size. For example, an L-size photograph has a length of 135 mm in the sheet conveying direction. An A4-size photograph has a length of 297 mm in the sheet conveying direction. The present invention can be widely used for such a printing apparatus that uses ink and that needs to dry ink, including a printer, complex printer, copier, a facsimile apparatus, and manufacture apparatuses of various devices.

Figure 1:
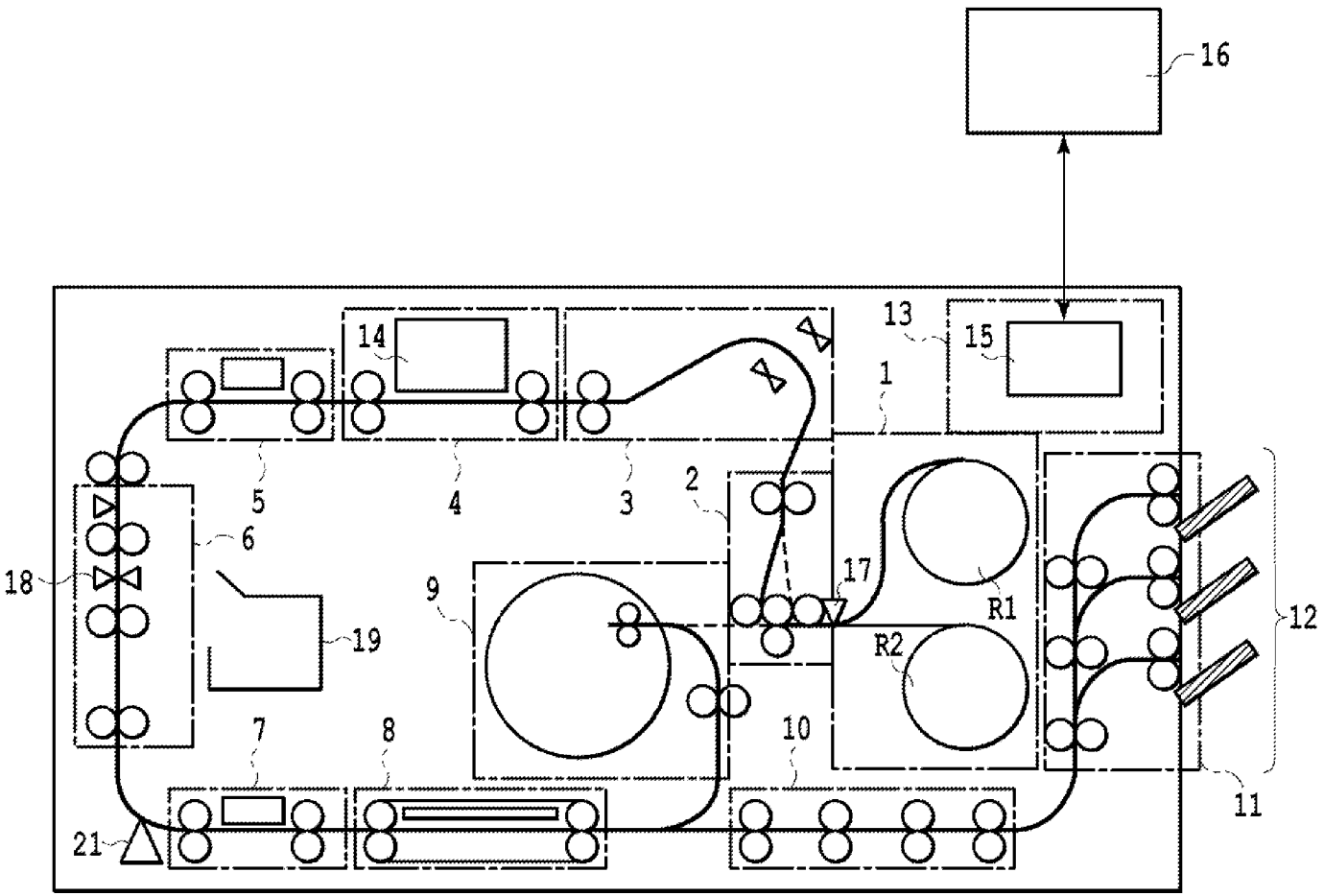
FIG. 1 is a schematic diagram illustrating the cross section of the interior configuration of a printing apparatus.

FIG. 1 is a schematic cross-sectional view illustrating the interior configuration of the printing apparatus of this embodiment. The printing apparatus of this embodiment is configured so that a rolled sheet can be subjected to a double-sided printing in which the first face and the second face provided at the back face side of the first face of the sheet are both printed. The printing apparatus interior generally includes: a sheet supply unit 1; decurl unit 2, a positional deviation correction unit 3, a printing unit 4, an inspection unit 5, a cutter unit 6, an information printing unit 7, a drying unit 8, a reverse unit 9, a discharge/conveying unit 10, a sorter unit 11, a discharge unit 12, and a control unit 13, respectively. The discharge unit 12 is a unit that includes the sorter unit 11 to perform a discharge processing. The sheet is conveyed by a conveying mechanism composed of a roller pair or a belt along the sheet conveying path shown by the solid line and is processed by the respective units. With regard to an arbitrary position on the sheet conveying path, a side closer to the sheet supply unit 1 is called as "upstream" and a side at an opposite side is called as "downstream".

The sheet supply unit 1 is a unit that supplies a rolled continuous sheet while retaining the sheet. The sheet supply unit 1 can store therein two rolls R1 and R2 and is configured to selectively draw a sheet to supply the sheet. The number of rollers that can be stored are not limited to two. Thus, one roller or three or more rollers also may be stored. A continuous sheet is not limited to a rolled configuration. For example, the continuous sheet may have another configuration in which a continuous sheet having a perforation at each unit length is folded and layered at each perforation for storage in the sheet supply unit 1.

At the sheet supply unit 1 side, a unique portion detecting sensor 17 (sensing unit) is provided that reads a unique portion mark and a unique portion announcement mark. The unique portion is a region in which a continuous sheet supplied from the sheet supply unit 1 partially has a different characteristic. The details of the unique portion will be described later.

The decurl unit 2 is a unit to reduce the curl (warpage) of the sheet supplied from the sheet supply unit 1. The decurl unit 2 is configured so that two pinch rollers are used to one driving roller to curl so as to warp the sheet therebetween in a direction opposite to the curling direction to thereby apply a decurling force to the sheet to reduce the curl.

The positional deviation correction unit 3 is a unit that corrects the positional deviation of the sheet having passed through the decurl unit 2 (an inclination to the original direction along which the sheet is conveyed). A sheet end as a reference is pushed to a guide member to thereby correct the positional deviation of the sheet. The positional deviation correction unit 3 forms a loop of the conveyed sheet.

The printing unit 4 is a sheet processing unit in which a conveyed sheet is subjected to a print processing by the print head 14 from the upper side to form an image. Specifically, the printing unit 4 is a processing unit that performs a predetermined processing on a sheet. The printing unit 4 also includes a plurality of conveying rollers for conveying a sheet. The print head 14 has a line-type print head in which inkjet nozzle rows are formed so as to cover the maximum width of a sheet to be used. The print head 14 is configured so that a plurality of print heads are arranged to be parallel to one another along the conveying direction. In this example, the print head 14 has seven print heads corresponding to the seven colors of C (cyan), M (magenta), Y (yellow), LC (light cyan), LM (light magenta), G (gray), and K (black). The number of colors and the number of print heads are not limited to seven. Such an inkjet method may be used including a method using a heater element, a method using a piezoelectric element, a method using an electrostatic element, and a method using an MEMS element. The inks of the respective colors are supplied from an ink tank to the print head 14 via ink tubes, respectively.

The inspection unit 5 is a unit that uses a scanner to optically read an inspection pattern or an image printed by the printing unit 4 to inspect the nozzle status and the sheet conveying status of the print head and the image position for example to determine whether the image is correctly printed or not. The scanner has a CCD image sensor or a CMOS image sensor.

The cutter unit 6 is a unit that includes a mechanical cutter to cut a printed sheet to have a predetermined length. The cutter unit 6 also includes a cut mark sensor for optically detecting a cut mark printed on a sheet and a plurality of conveying rollers for sending a sheet to the next step. A trash bin 19 is provided in the vicinity of the cutter unit 6. The trash bin 19 stores therein small sheet pieces generated as trash of sheet pieces cut off by the cutter unit 6. The cutter unit 6 includes a mechanism to discharge the cut sheet into the trash bin 19 or to move the cut sheet to the original conveying path.

The information printing unit 7 is a unit that prints, on a no-print region of the cut sheet, print information such as the print serial number or the date (unique information). The printing is performed by using an inkjet method or a thermal transfer method for example to prints characters or a code. At the upstream side of the information printing unit 7 and at the downstream side of the cutter unit 6, the sensor 21 is provided that senses a tip end edge of a cut sheet. Based on the sensing timing of the sensor 21, the timing at which information is printed by the information printing unit 7 is controlled.

The drying unit 8 is a unit that heats a sheet printed by the printing unit 4 to dry applied ink for a short time. The drying unit 8 is internally configured so that hot air is applied at least from the lower face side to the sheet sent through the interior to thereby dry the face applied with ink. The drying method is not limited to the method of applying hot air and also may be a method of irradiating the sheet top face with electromagnetic waves (e.g., ultraviolet rays or infrared rays).

A sheet conveying path from the sheet supply unit 1 to the drying unit 8 will be called as a first path. The first path has a U-turn shape between the printing unit 4 and the drying unit 8. The cutter unit 6 is provided in the middle of the U-turn shape.

The reverse unit 9 is a unit to temporarily wind, during the double-sided printing, the printed continuous sheet over the top face (the first face) to invert the top face and the back face. The reverse unit 9 is used to supply the sheet having passed through the drying unit 8 to the printing unit 4 again. The reverse unit 9 is provided in the middle of a path extending from the drying unit 8 via the decurl unit 2 to the printing unit 4 (loop path) (which is called as a second path). The reverse unit 9 includes a winding rotating body (drum) that is used to wind a sheet. A not-yet-cut sheet for which the top face is already printed is temporarily wound around the winding rotating body. After the winding, the winding rotating body is reversely-rotated to send the wound sheet to the decurl unit 2 in an opposite order to that used during winding. Since this sheet has reversed top and back faces, the back face (the second face) can be printed by the printing unit 4. When assuming that the sheet supply unit 1 is the first sheet supply unit, the reverse unit 9 can be assumed as the second sheet supply unit. A more specific operation of the double-sided printing will be described later.

The discharge/conveying unit 10 is a unit to convey, to the sorter unit 11, a sheet having been cut by the cutter unit 6 and dried by the drying unit 8. The discharge/conveying unit 10 is provided in a path different from the second path including the reverse unit 9 (which will be called as the third path). In order to selectively guide the sheet having been conveyed along the first path to any one of the second path and the third path, a path branching position (called as "discharge branching position") has a path switching mechanism having a movable flapper.

The discharge unit 12 including the sorter unit 11 is provided at the side of the sheet supply unit 1 and at an end of the third path. The sorter unit 11 is a unit to optionally sort printed sheets to the respective groups. The sorted sheets are discharged into a plurality of trays owned by the discharge unit 12. As described above, the third path is configured to extend at the lower side of the sheet supply unit 1 to discharge a sheet in an opposite direction as that of the printing unit 4 and the drying unit 8 with regard to the sheet supply unit 1.

As described above, the components from the sheet supply unit 1 to the drying unit 8 are sequentially provided in the first path. The drying unit 8 is branched to the second path and the third path. A reverse unit 9 is provided in the middle of the second path. The reverse unit 9 merges with the first path. An end of the third path has the discharge unit 12.

The control unit 13 is a unit to control the respective units of the entire printing apparatus. The control unit 13 has: a CPU, a storage apparatus, a controller including various control units, an external interface, and an operation unit 15 through which an input or output is made by a user. The operation of the printing apparatus is controlled based on an instruction from the controller or a host apparatus 16 (e.g., host computer) connected to the controller via an external interface.

Figure 2:
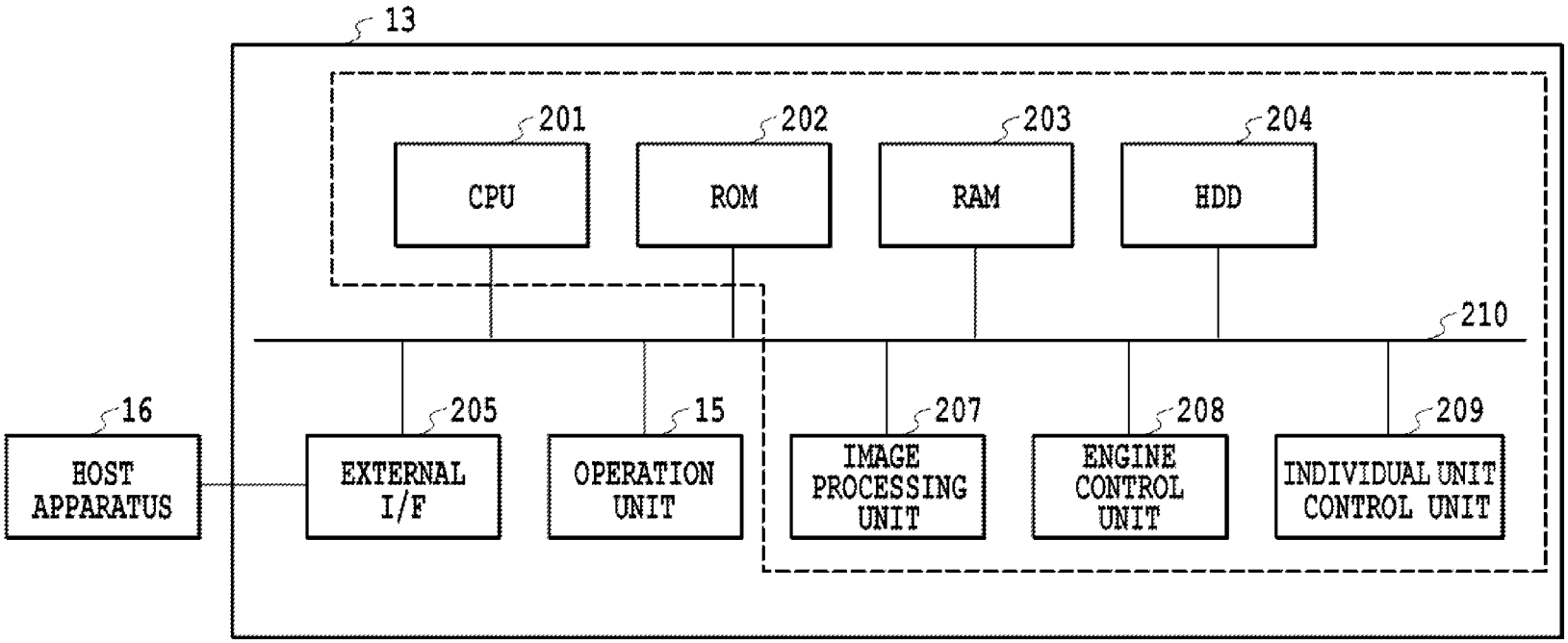
FIG. 2 is a block diagram illustrating the concept of a control unit.

FIG. 2 is a block diagram illustrating the concept of the control unit 13 of this embodiment. The controller included in the control unit 13 (which is shown by a range surrounded by the dashed line) is composed of: a CPU 201, a ROM 202, a RAM 203, a HDD 204, an image processing unit 207, an engine control unit 208, and an individual unit control unit 209. The CPU 201 (central processing unit) controls the operations of the respective units of the printing apparatus in an integrated manner. The ROM 202 stores therein programs to be executed by the CPU 201 and fixed data required for various operations of the printing apparatus. The RAM 203 is used as a work area of the CPU 201 or is used as a temporary storage region for various received data or functions to store various setting data. The HDD 204 (hard disc) can store and read programs to be executed by the CPU 201, print data, and fixed data required for various operations of the printing apparatus. The operation unit 15 is an input/output interface for a user that includes an input unit (e.g., a hard key or a touch panel) and an output unit (e.g., a display for displaying information or an audio generator).

A unit required to perform a high-speed data processing includes an exclusive processing unit. The image processing unit 207 performs an image processing on print data handled by the printing apparatus by converting the color space of inputted image data (e.g., YCbCr) to a standard RGB color space (e.g., sRGB). The image data is also optionally subjected to various image processings (e.g., resolution conversion, image analysis, image correction). Print data obtained through these image processings is stored in the RAM 203 or the HDD 204. The engine control unit 208 controls, based on a control command received from the CPU 201 for example, the driving of the print head 14 of the printing unit 4 depending on the print data. The engine control unit 208 also controls the conveying mechanism of each unit in the printing apparatus. The individual unit control unit 209 is a subcontroller that individually controls the respective units of the sheet supply unit 1, the decurl unit 2, the positional deviation correction unit 3, the inspection unit 5, the cutter unit 6, the information printing unit 7, the drying unit 8, the reverse unit 9, the discharge/conveying unit 10, the sorter unit 11, and the discharge unit 12. Based on an instruction from the CPU 201, the operations of the respective units are controlled by the individual unit control unit 209. The external interface 205 is an interface (I/F) to connect the controller to the host apparatus 16 and is a local I/F or a network I/F. The components as described above are connected by a system 210.

The host apparatus 16 is an apparatus that functions as a supply source of image data used for the printing by the printing apparatus. The host apparatus 16 may be a general or exclusive computer or also may be an exclusive image device (e.g., an image capture having an image reader, a digital camera, or photo storage). When the host apparatus 16 is a computer, then application software for generating image data and a printer driver for the printing apparatus are installed in a storage apparatus included in the computer. The entire processing is not necessarily carried out by software and thus the processing may be partially or entirely carried out by hardware.

Next, the following section will describe a basic printing operation. A printing operation is different depending on a one-sided printing mode and a double-sided printing mode. Thus, the respective printing modes will be described.

In the one-sided printing mode, a sheet having been supplied from the sheet supply unit 1 and having been processed by the decurl unit 2 and the positional deviation correction unit 3 respectively is subjected to a printing operation of the top face (the first face) by the printing unit 4. Images (unit images) having a predetermined unit length are sequentially printed on the long continuous sheet in the conveying direction to thereby sequentially form a plurality of images. The printed sheet is sent through the inspection unit 5 and is cut by the cutter unit 6 to correspond to the respective unit images. The back face (the second face) of the cut sheet has optionally thereon print information printed by the information printing unit 7. The cut sheets are conveyed to the drying unit 8 one by one and are dried. Thereafter, the cut sheets are sent through the discharge/conveying unit 10 and are sequentially discharged into the discharge unit 12 of the sorter unit 11. On the other hand, a sheet left at the printing unit 4 side after the final cutting of the unit image is returned to the sheet supply unit 1 and is wound around the roll R1 or R2. As described above, in the one-sided printing, the sheet is processed through the first path and the third path and does not pass through the second path.

On the other hand, in the double-sided printing mode, the top face (first face) printing sequence is followed by the back face (second face) printing sequence. In the first top face printing sequence, the operations of the respective units from the sheet supply unit 1 to the inspection unit 5 are the same as those of the above-described one-sided printing. A continuous sheet is not cut by the cutter unit 6 and is directly conveyed to the drying unit 8. After the ink on the top face is dried by the drying unit 8, the sheet is guided not to the path at the discharge/conveying unit 10 side (the third path) but to the side at the reverse unit 9 side (the second path). In the second path, the sheet is wound around the winding rotating body of the reverse unit 9 rotating in a forward direction (counterclockwise direction in the drawing). When the top face is completely printed by the printing unit 4 as planned, then the cutter unit 6 cuts a rear end of the print region continuous sheet. Based on the cut position as a reference, the continuous sheet at the downstream side in the conveying direction (printed side) is sent through the drying unit 8 and is wounded by the reverse unit 9 until the sheet rear end (cut position) is reached. On the other hand, simultaneous with the winding by the reverse unit 9, the continuous sheet at the upstream side than the cut position in the conveying direction (printing unit 4 side) is returned to the sheet supply unit 1 so that no sheet tip end (cut position) is left in the decurl unit 2. Then, the sheet is wound around the roll R1 or R2. This backfeeding operation can prevent the situation where the sheet collides with a sheet supplied again by a back face printing sequence described below.

After the above-described top face printing sequence, the back face printing sequence is carried out. The winding rotating body of the reverse unit 9 is rotated in a direction opposite to the winding direction (clockwise direction in the drawing). An end of the wound sheet (the sheet rear end during the winding is a sheet front end during paper ejection) is sent into the decurl unit 2 along the path shown by the dashed line. The decurl unit 2 corrects the curl given by the winding rotating body. Specifically, the decurl unit 2 is provided the sheet supply unit 1 and the printing unit 4 in the first path and is provided between the reverse unit 9 and the printing unit 4 in the second path and functions as a common unit to decurl the sheet in any of the paths. The sheet for which the top side and the back side are inverted is sent via the positional deviation correction unit 3 to the printing unit 4 in which the back face of the sheet is printed. The printed sheet is sent via the inspection unit 5 to the cutter unit 6 through which the sheet is cut to have a predetermined unit length set in advance. Since both faces of the cut sheet are printed, the sheet is not subjected to a printing operation by the information printing unit 7. Then, the cut sheets are conveyed one by one to the drying unit 8 and are sequentially discharged and accumulated in the discharge unit 12 of the sorter unit 11 via the discharge/conveying unit 10. As described above, in the double-sided printing, the sheet passes through the first path, the second path, the first path, and the third path in this order and is processed.

Next, the following section will detail a unique portion included in the continuous sheet. The unique portion is a region in the continuous sheet in which the continuous sheet partially has a different characteristic including, for example, a region including dust, a hole, a flaw, a part at which a sheet is connected to a sheet, a folded part, a broken part, mixed foreign material, discoloration, an uneven thickness, or dirt.

A unique portion mark, which is used to identify a unique portion, is recorded in a predetermined range that includes a unique portion on the sheet and that is set to include a range including a front side and a rear side of the unique portion including an error. This mark means that the unique portion exists at the position. Specifically, the unique portion mark is recorded as information indicating the position of the unique portion. The unique portion mark is recorded in advance during the manufacture of the sheet and is not printed by the printing apparatus of the embodiment. The unique portion mark may be sensed by the unique portion detecting sensor 17 and may be a simple rectangular mark, a barcode, a QR code, a specific shape, or a character for example. The unique portion mark is recorded so that whether the unique portion region exists in the first face of the sheet or the in the second face corresponding to the back face can be determined. The unique portion mark is provided in the vicinity of each unique portion at a position slightly separated from the unique portion toward the downstream side (top end of the roll paper).

Information showing the position of the unique portion existing in the sheet is not limited to a unique portion mark printed in the middle of the sheet and also may be a barcode collectively printed at the front end of the sheet for example. Instead of this information included in the continuous sheet, this information also may be collectively recorded in a package packaging a sheet so that a user can input the information to the host apparatus. Alternatively, a memory medium including collectively-recorded information may be attached to the sheet package so that the user can input the information to the host apparatus. The information can be acquired by reading the information inputted to the host apparatus.

Next, the following section will detail the operation sequence based on the printing schedule in the one-sided printing mode. The unique portion detecting sensor 17 of the printing apparatus of this embodiment is an optical sensor provided at the sheet supply unit 1 side. The unique portion detecting sensor 17 senses a unique portion mark for identifying a unique portion region printed on a print face of a sheet of a roll paper.

Figure 3:
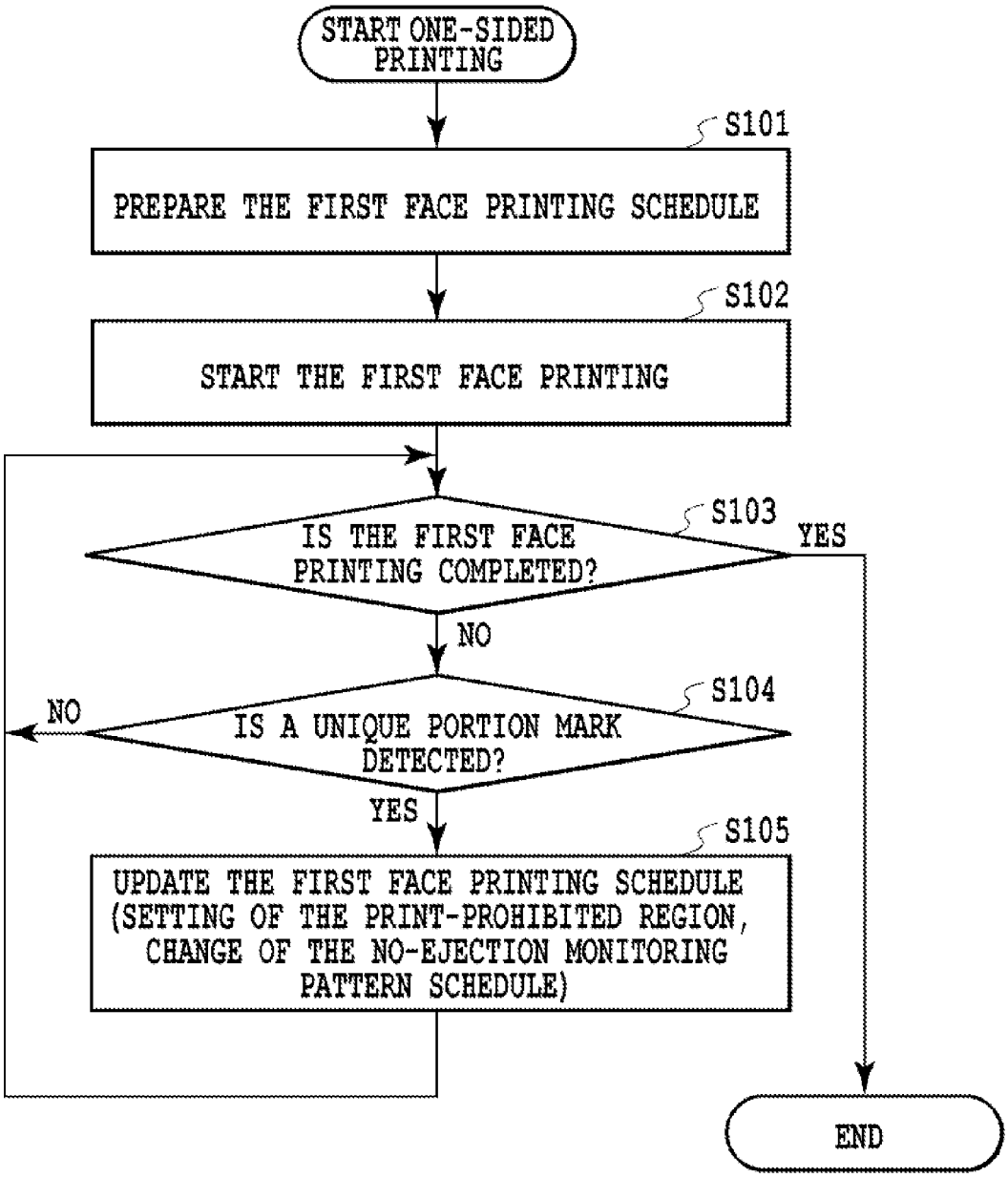
FIG. 3 is a flowchart illustrating the printing flow.

FIG. 3 is a flowchart illustrating the flow of the printing operation using the printing apparatus of this embodiment. Based on an instruction to start the printing operation, the first face printing schedule is prepared (Step S101). The printing schedule is data defining a plurality of unit images sequentially formed on a continuous sheet, a cut mark formed in a space between neighboring images, a preliminary ejection pattern for preliminary ejection, a ejection failure monitoring pattern for monitoring ejection failure, and an order of the arrangement of space regions. The schedule is prepared so that a preliminary ejection functioning as one of the print head maintenances is performed on the front end and the ejection failure monitoring pattern functioning as another print head maintenance is performed at every predetermined interval and is inserted at the end of the image.

Figure 4A:
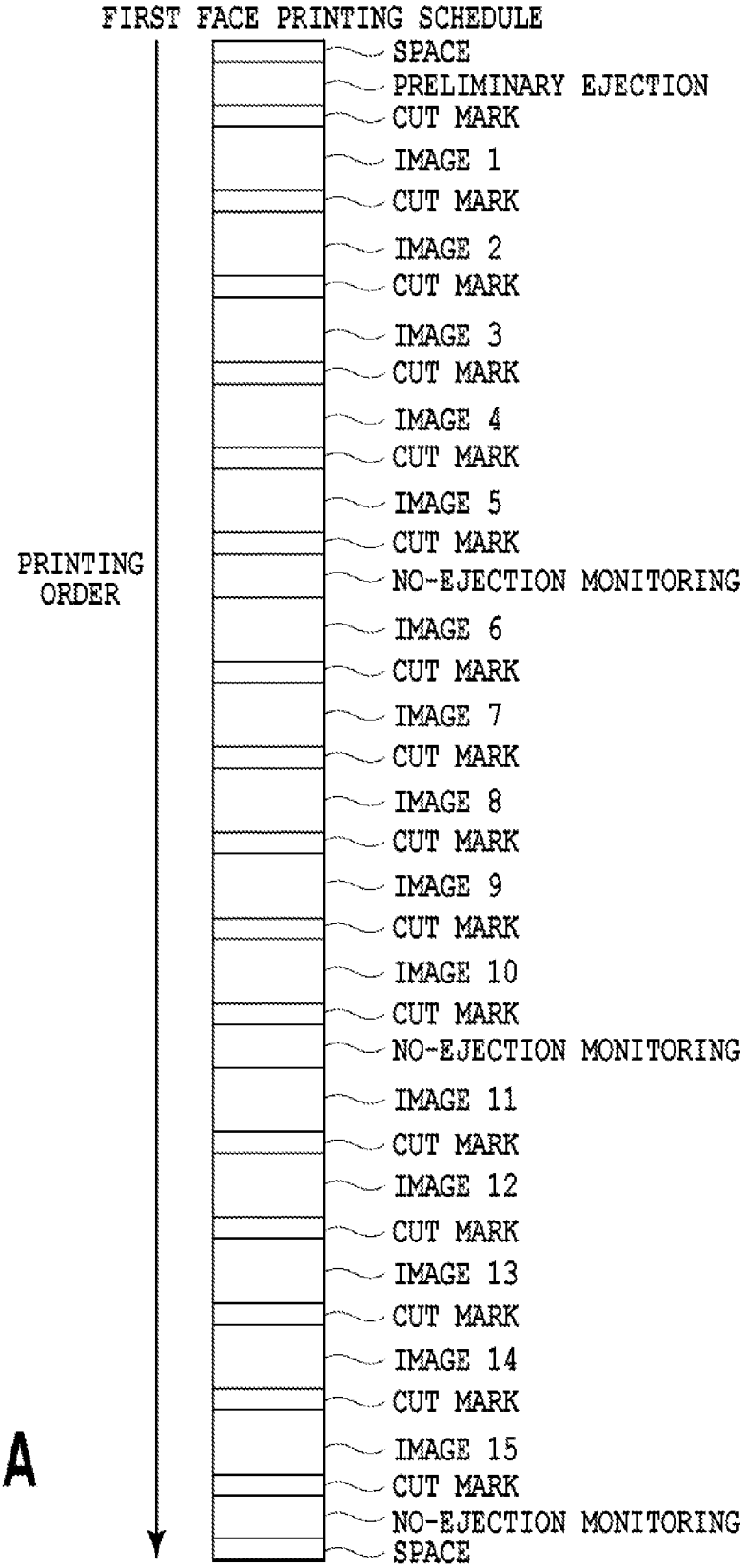
FIG. 4A to FIG. 4C are a schematic view illustrating an example of a printing schedule.
Figure 4B:
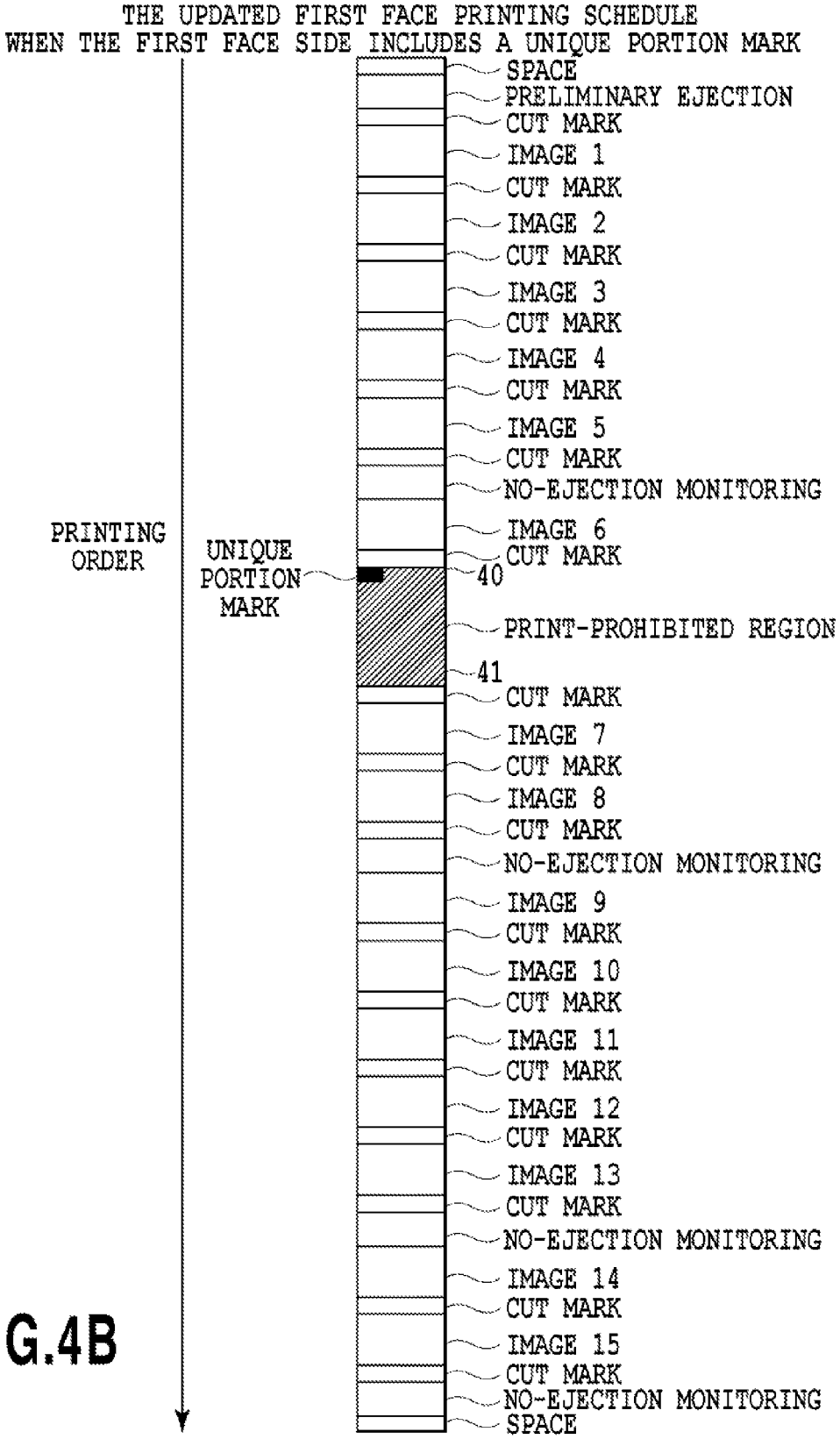
Figure 4C:
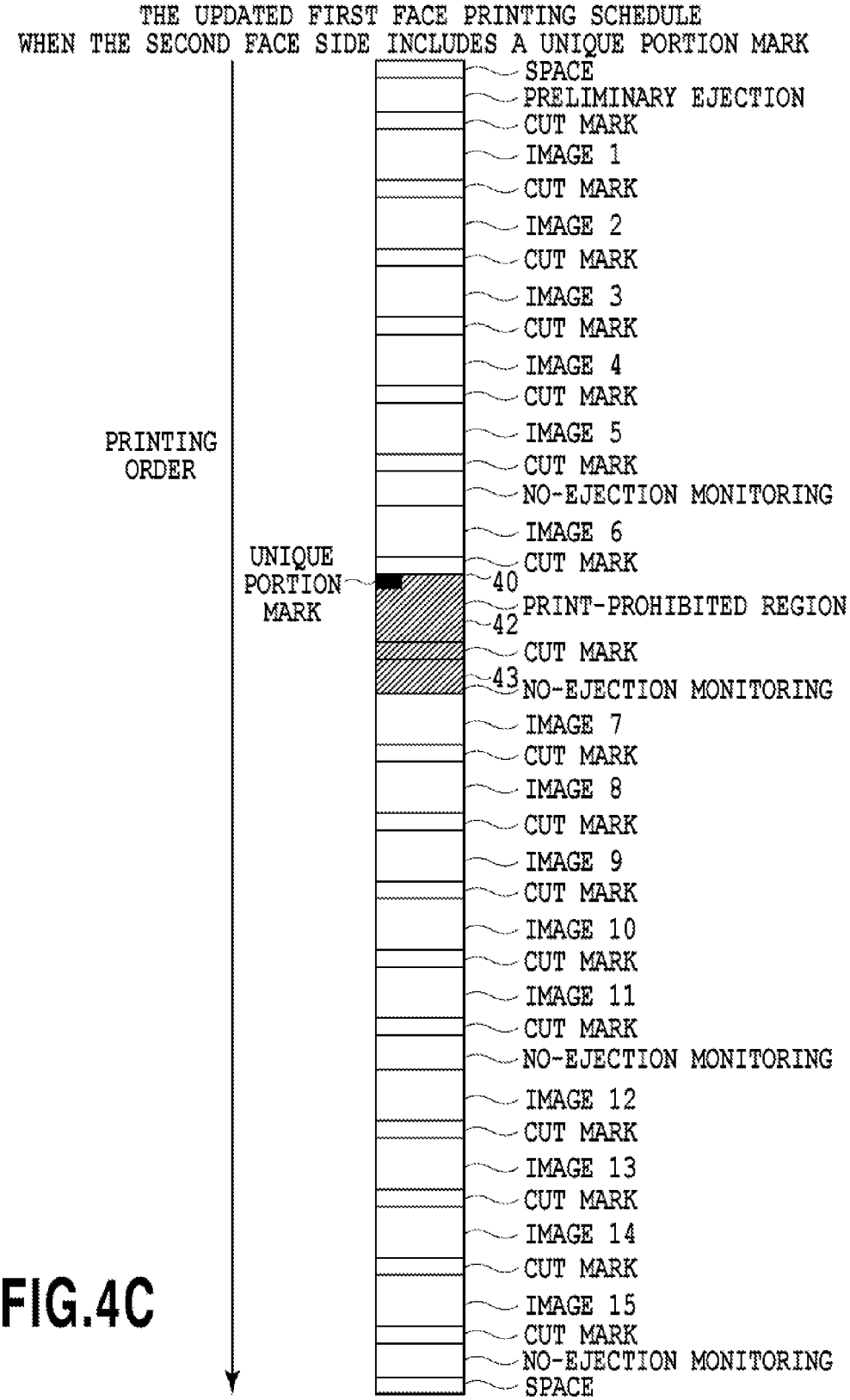

FIG. 4A to FIG. 4C are a schematic view illustrating an example of the printing schedule of this embodiment. FIG. 4A shows the printing schedule described in Step S101.

Next, based on the prepared first face printing schedule, a unit image and a maintenance pattern are sequentially printed on the continuous sheet based on a predetermined order (Step S102). Then, whether the first face printing specified in the first face printing schedule is entirely completed (Yes) or not entirely completed (No) is determined (Step S103). When the first face printing is entirely completed (Yes), then the sequence is completed. When the first face printing is not entirely completed (No), it is determined whether the unique portion mark of the continuous sheet is sensed by the unique portion detecting sensor 17 or not (Step S104). When no unique portion mark is sensed (No), the processing returns to Step S103 to repeat the processing.

On the other hand, when the unique portion mark is sensed (Yes), then a processing is performed to update the first face printing schedule (Step S105). The processing to update the printing schedule is a processing to insert a print-prohibited region corresponding to the detected unique portion mark and to update the position at which the ejection failure monitoring pattern is inserted.

FIG. 4B shows the updated first face printing schedule when the processing for sensing a unique portion mark detects that the first face side during printing has a unique portion region. In the first face printing schedule, the unique portion mark sensed position 40, the print-prohibited region 41 having a predetermined width, and a cut mark are inserted in this order. The first face printing schedule at an initial stage does not have the print-prohibited region 41 or a cut mark following the print-prohibited region 41. The print-prohibited region is a region for which the print head is not driven and a space is left. In order to arrange the ejection failure monitoring pattern with a predetermined interval, the first face printing schedule at the initial stage includes the ejection failure monitoring patterns after the image 10 and the image 15. The schedule is updated to include the ejection failure monitoring patterns after the image 8, the image 13, and the image 15.

FIG. 4C shows the first face printing schedule updated when the processing for sensing the unique portion mark detects that the second face side opposed to the first face during printing has a unique portion region. Then, the first face printing schedule is set to newly include the unique portion mark sensed position 40, the print-prohibited region 42 having a predetermined width, a cut mark and the ejection failure monitoring pattern 43 in this order. The first face printing schedule at the initial stage does not include the print-prohibited region 42 and the subsequent cut mark and ejection failure monitoring pattern 43. The position at which the ejection failure monitoring pattern 43 is inserted is originally a print-prohibited region. However, in this case, the printing face (the first face) has no unique portion and thus can be used for a processing for monitoring ejection failure. Thus, the ejection failure monitoring pattern can be inserted at this position. The initial printing schedule is similarly updated for the subsequent ejection failure monitoring patterns so that the ejection failure monitoring patterns provided after the image 10 and the image 15 are moved to follow the image 11 and the image 15 so that a predetermined interval is maintained from the ejection failure monitoring pattern 43.

Based on the first face printing schedule newly set as described above, the printing operation to the first face is continued. Then, the processing returns to Step S103 to repeat a similar processing. When many unit images are printed by one first face printing, a plurality of unique portion marks may be sensed during the one processing.

As described above, the first face printing schedule is reset so that, when a unique portion mark (unique portion region) in a continuous sheet is sensed during the printing on the first face in the one-sided printing mode, then the print-prohibited region including the unique portion region is formed on the first face based on the sensing result. The schedule is updated so that a predetermined interval can be maintained for the ejection failure monitoring pattern. When it is sensed that the second face side opposed to the first face during printing has a unique portion region, the schedule is updated so that the print-prohibited region newly includes a ejection failure monitoring pattern. This can consequently reduce the use amount of the sheet including the ejection failure monitoring pattern.

As described above, the one-sided printing mode has been described. Next, the following section will detail the operation sequence based on the printing schedule for the double-sided printing mode.

The unique portion detecting sensor 17 is an optical sensor provided at the sheet supply unit 1 side. Thus, the unique portion detecting sensor 17 can sense a unique portion mark only when the sheet is supplied for the first face printing. Specifically, the unique portion detecting sensor 17 does not sense a unique portion when the sheet is supplied from the reverse unit 9 for the second face printing. Thus, based on the sensing result of the unique portion mark in the first face printing, a position of the unique portion mark during the second face printing is assumed based on the data so that the position can be avoided.

Figure 5:
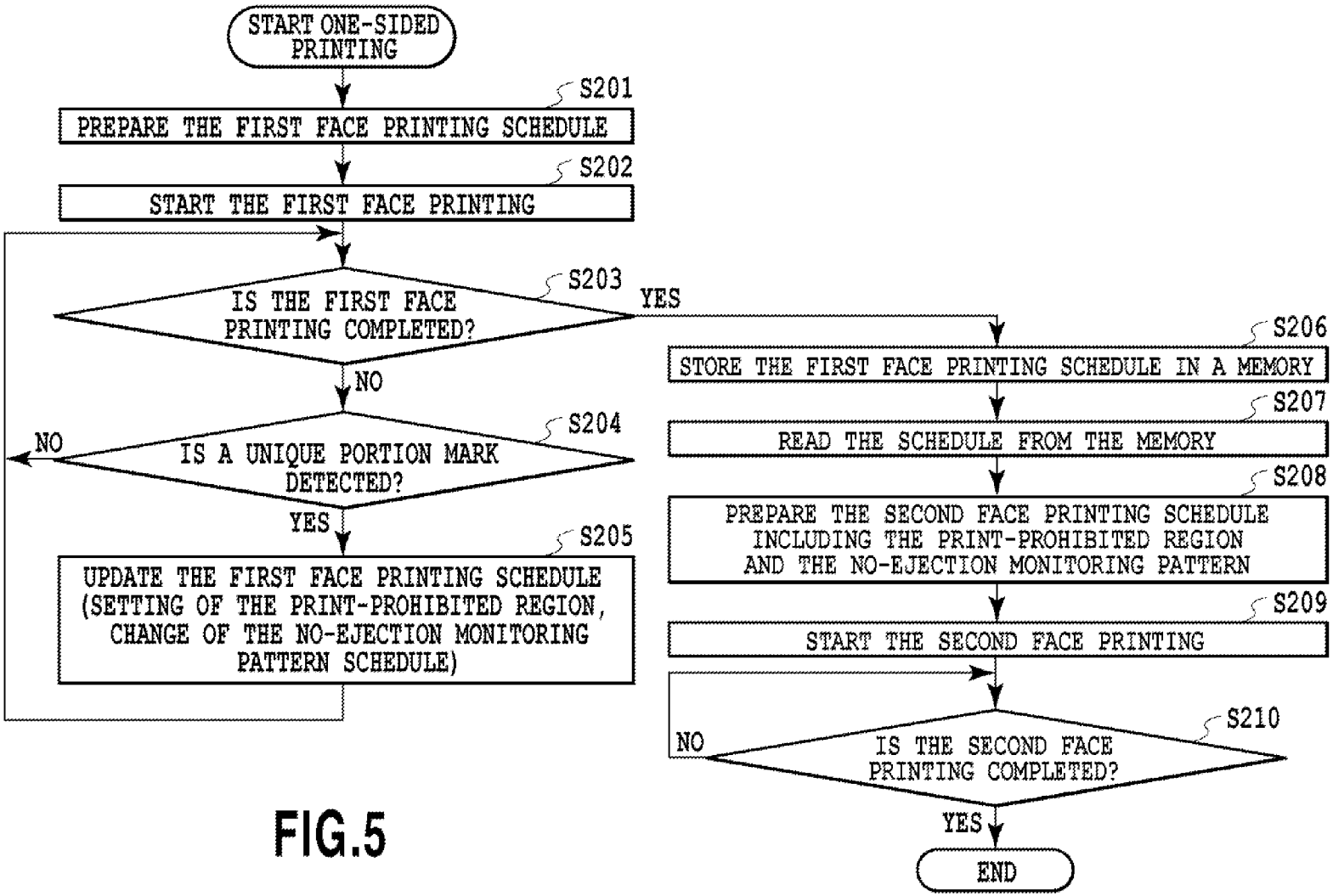
FIG. 5 is a flowchart illustrating the printing flow of the printing of the second embodiment.

FIG. 5 is a flowchart illustrating the flow of the printing operation using the printing apparatus of this embodiment. The print procedure is realized by the control of the control unit 13.

Steps S201 to S205 are the same as Steps S101 to S105 described in FIG. 3. After Step S203 determines that the first face printing is completed, then the processing proceeds to Step S206.

The latest first face printing schedule is stored in a memory of the control unit (RAM or HDD) (Step S206). If the originally-generated schedule is not deleted in the memory, this schedule also may be directly maintained.

Then, the schedule data printed in the memory is read (Step S207). Then, the second face printing schedule is prepared (Step S208). The schedule is prepared based on the first face printing schedule read out in Step S207. The reason is that the printing operation must be performed so that the position of the unit image printed on the first face accurately corresponds to the position of the unit image printed on the second face. If the first face printing schedule includes the print-prohibited region 31, the print-prohibited region 32 is set at the same position on the sheet back face. The second face printing schedule is different depending on whether the print-prohibited region 31 in the first face printing schedule includes a unique portion region on the first face or a unique portion region on the second face region.

Next, based on the prepared second face printing schedule, the unit image and the maintenance pattern are sequentially printed in a predetermined order on the second face (back face) of the continuous sheet wound around the winding rotating body. Then, whether the second face printing specified in the second face printing schedule is entirely completed (Yes) or is not completed (No) is determined (Step S210). When the determination results in Yes, it means that the double-sided printing is entirely completed, thus completing the sequence. When the determination results in No, the processing returns to Step S210 to repeat the processing.

Figure 6A:
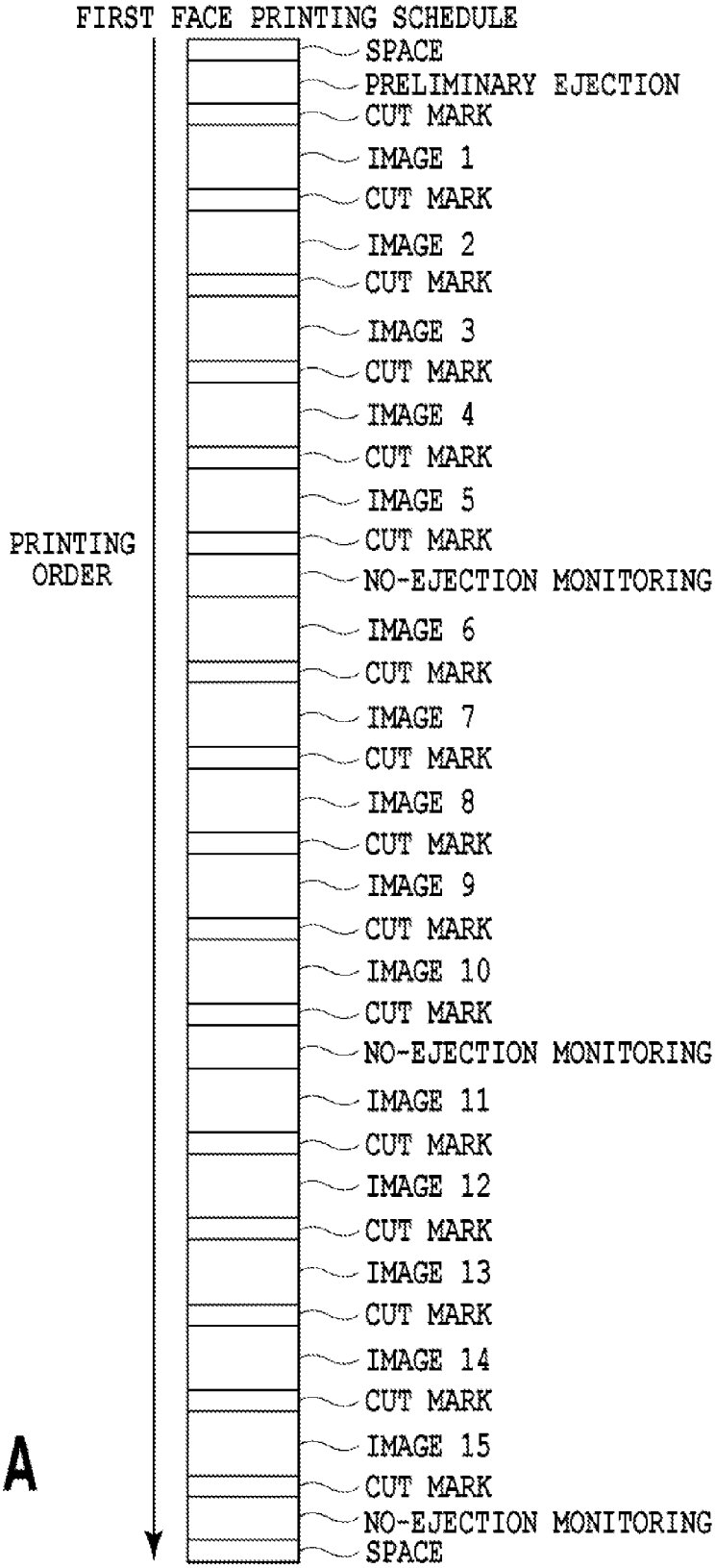
FIG. 6A to FIG. 6C are a schematic view illustrating an example of the printing schedule.
Figure 6B:
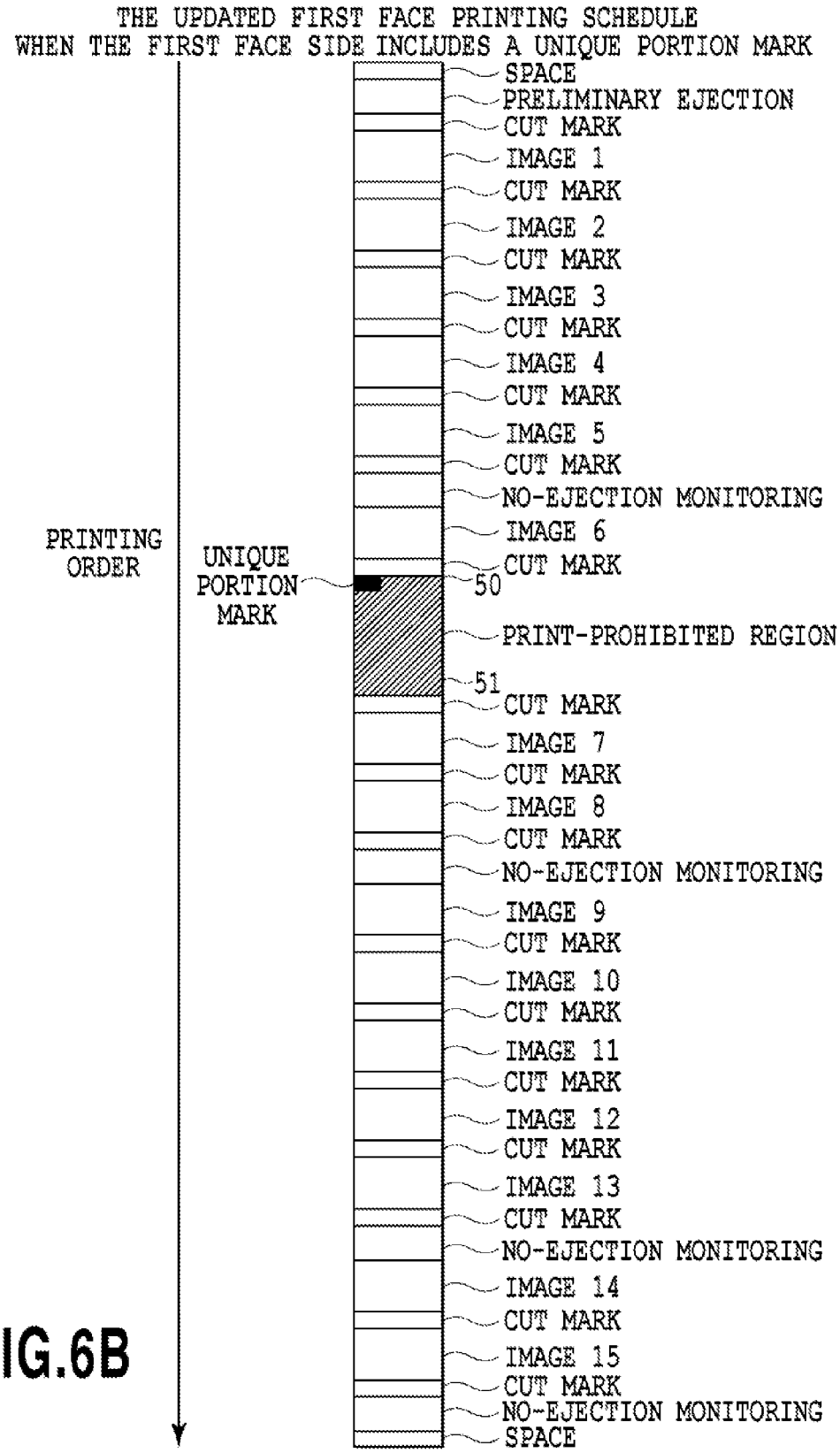
Figure 6C:
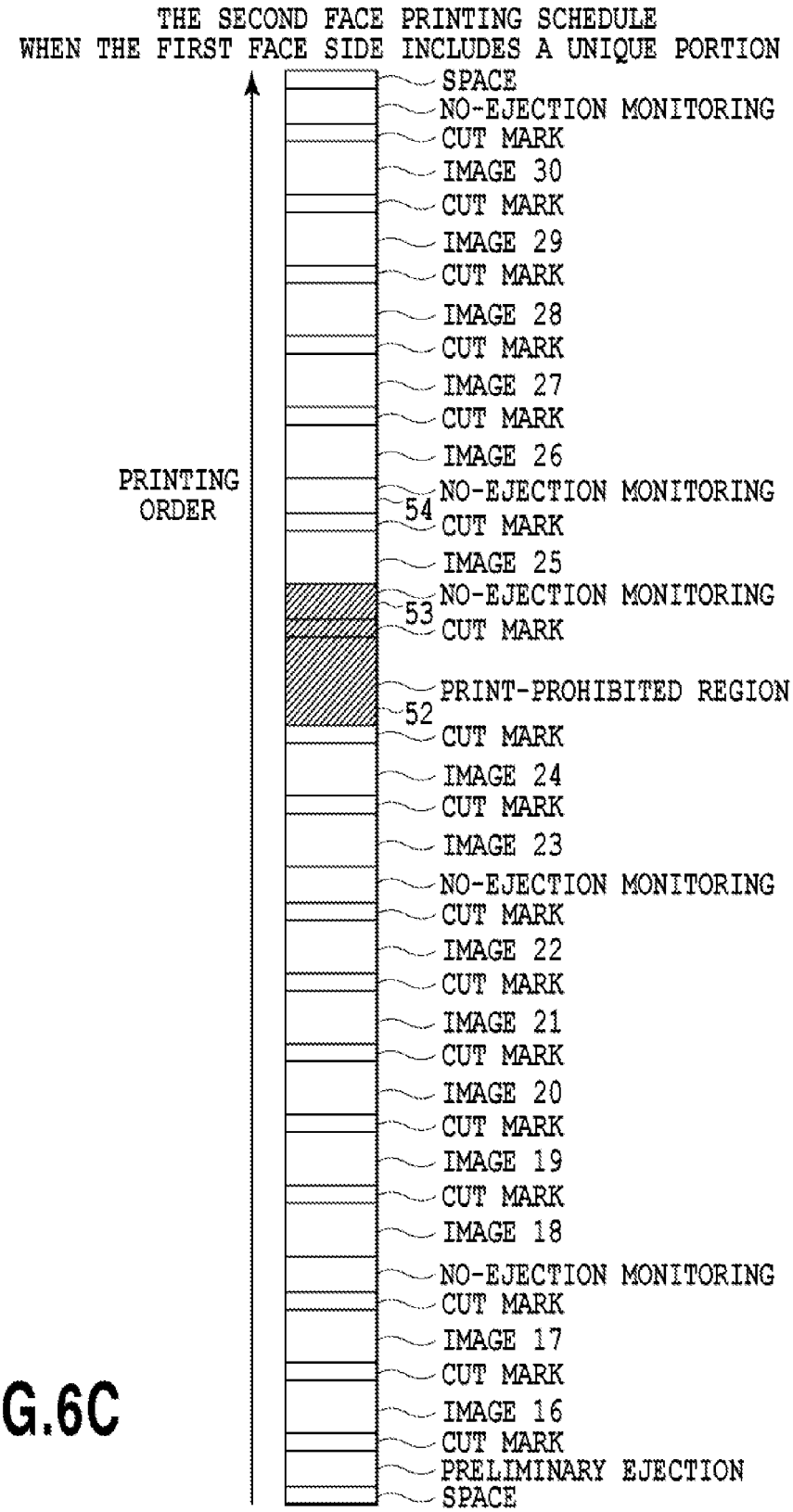

FIG. 6A to FIG. 6C a schematic view illustrating an example of the print schedule. FIG. 6A shows the first face printing schedule at an initial stage prepared in Step S201.

FIG. 6B shows an example of the first face printing schedule updated when the processing in Step S204 for sensing a unique portion mark detects that the first face during print includes a unique portion region. The first face printing schedule includes the unique portion mark sensed position 50, the print-prohibited region 51 having a predetermined width, and the cut mark in this order. In order to arrange the ejection failure monitoring pattern with a predetermined interval, the first face printing schedule at the initial stage includes the ejection failure monitoring patterns after the image 10 and the image 15. The schedule is updated to include the ejection failure monitoring patterns after the image 8, the image 13, and the image 15.

FIG. 6C shows an example of the second face printing schedule prepared based on the updated first face printing schedule of FIG. 6B in Step S208. The schedule is determined so that the image 1 corresponds to the image 30 for example so that the respective images of the first face are provided at the corresponding positions of the respective images of the second face. The ejection failure monitoring pattern is similarly provided at the position corresponding to the position of the ejection failure monitoring pattern of the first face, thereby maintaining a predetermined interval. Furthermore, at a position corresponding to the print-prohibited region 51 of the first face, the print-prohibited region 52 for avoiding image placement is provided and the ejection failure monitoring pattern 53 can be provided. The reason is that this print-prohibited region can be used for a ejection failure monitoring processing because the unique portion mark sensed processing of Step S104 detects that the first face side has a unique portion region and thus the second face has no unique portion.

As a result, when the ejection failure monitoring pattern 53 is not inserted for example and when the ejection failure monitoring for the ejection failure monitoring pattern 54 results in NG, it is determined that the image 23 to the image 25 are a defective print candidate. On the other hand, when the ejection failure monitoring pattern is inserted to the print-prohibited region of the second face and when the ejection failure monitoring for the ejection failure monitoring pattern 53 results in OK and the ejection failure monitoring for the ejection failure monitoring pattern 54 results in NG, then only the image 25 is determined as a defective print candidate. This can consequently provide an improved accuracy of the ejection failure monitoring determination.

Figure 7A:
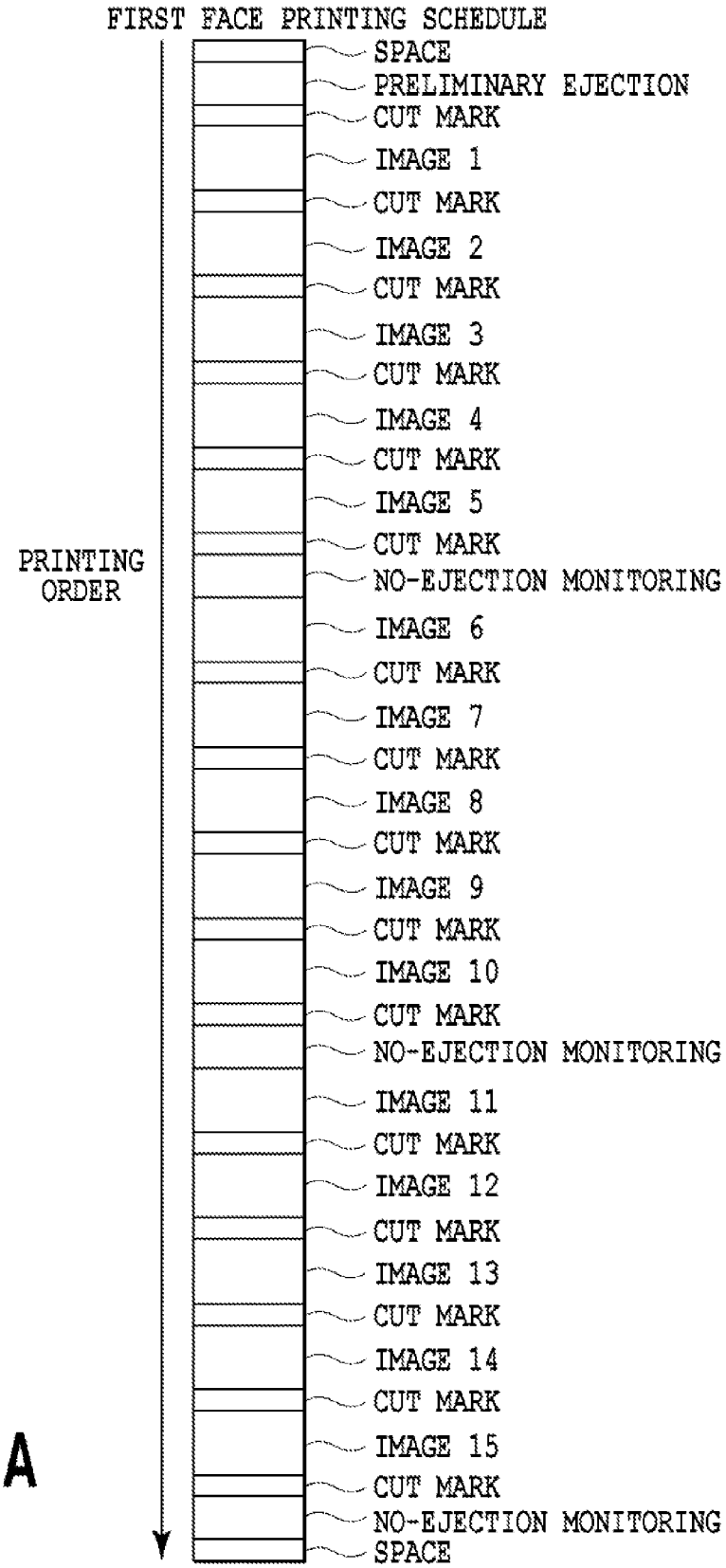
FIG. 7A to FIG. 7C are a schematic view illustrating an example of the printing schedule.
Figure 7B:
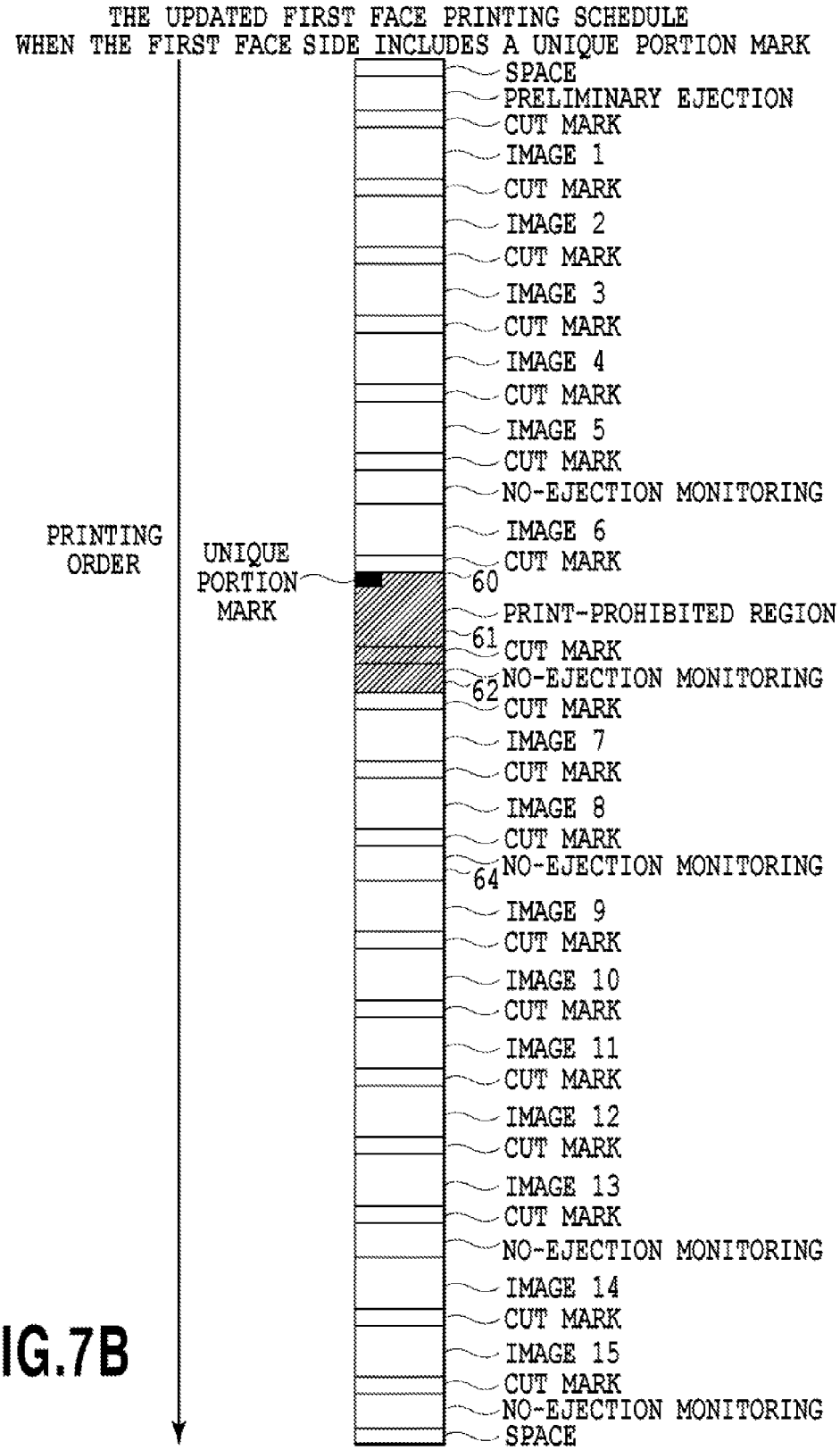
Figure 7C:
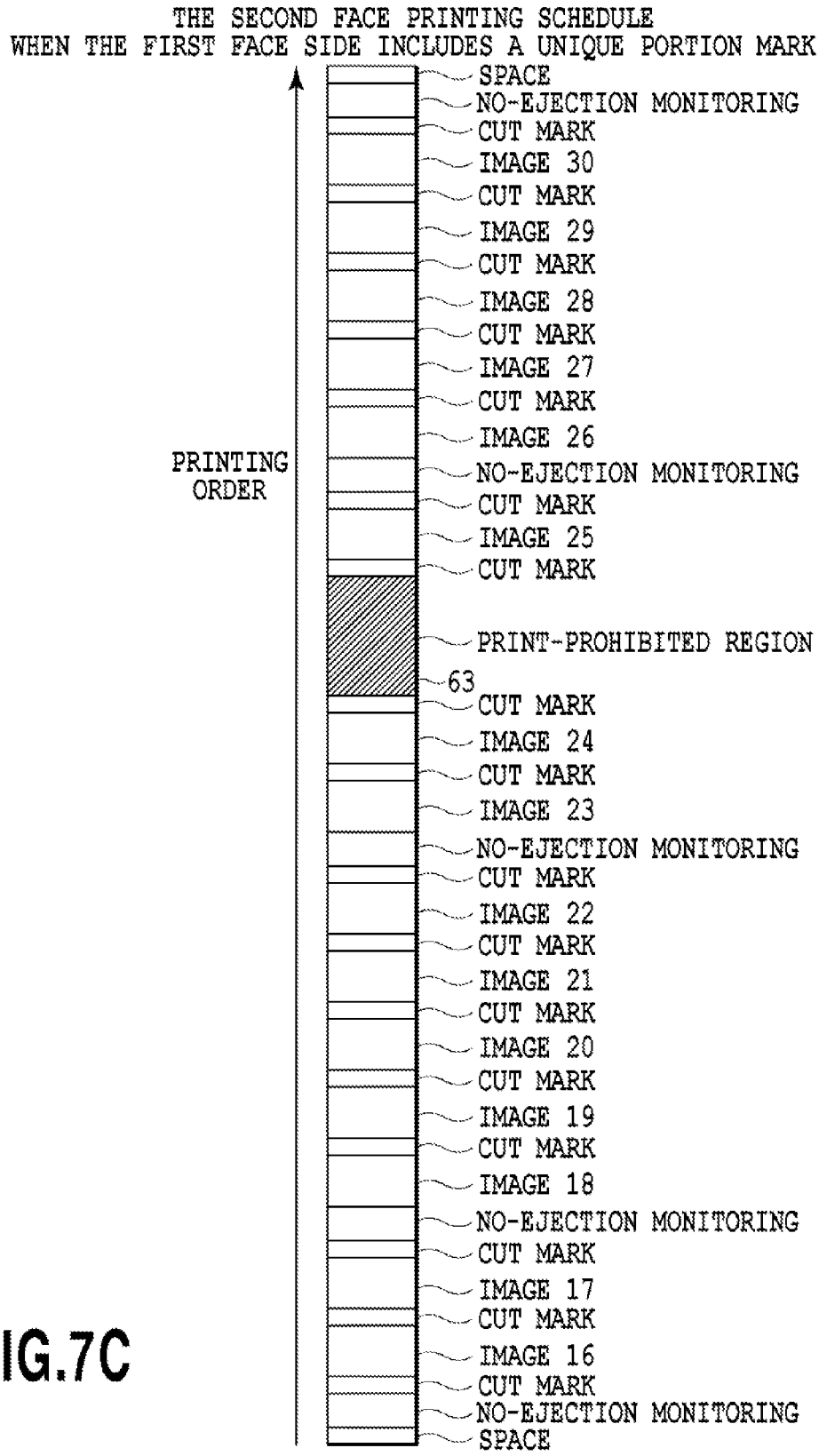

FIG. 7A to FIG. 7C are a schematic view illustrating an example of the print schedule. FIG. 7A shows the first face printing schedule at an initial stage prepared in Step S201.

FIG. 7B shows an example of the first face printing schedule updated when the processing for sensing the unique portion mark in S204 detects that the second face side opposed to the first face during printing has a unique portion region. The first face printing schedule includes the unique portion mark sensed position 60, the print-prohibited region 61 having a predetermined width, and the cut mark and the ejection failure monitoring pattern 62 in this order. The position at which the ejection failure monitoring pattern is inserted is originally a print-prohibited region. However, in this case, the printing face (the first face) has no unique portion and thus can be used for a processing for monitoring ejection failure. Thus, the position can have a ejection failure monitoring pattern. The schedule is determined for the subsequent ejection failure monitoring pattern so that a predetermined interval is maintained from the ejection failure monitoring pattern in the one-sided printing mode. However, in the double-sided printing mode, in order to maintain a predetermined interval in the ejection failure monitoring pattern in the second face, the schedule is updated to include the ejection failure monitoring patterns after the image 8, the image 13, and the image 15 instead of using the ejection failure monitoring pattern 62 as a starting point.

FIG. 7C shows an example of the second face printing schedule prepared based on the updated first face printing schedule in Step S208 of FIG. 7B. The schedule is determined so that the image 1 corresponds to the image 30 for example so that the respective images of the first face are provided at the corresponding positions of the respective images of the second face. The ejection failure monitoring pattern is similarly provided at the position corresponding to the position of the ejection failure monitoring pattern of the first face, thereby maintaining a predetermined interval. Furthermore, at a position corresponding to the print-prohibited region 61 of the first face, the cut mark, and the ejection failure monitoring pattern 62, the print-prohibited region 63 for avoiding image placement is provided.

As a result, when the ejection failure monitoring pattern 62 is not provided for example and when the ejection failure monitoring of the ejection failure monitoring pattern 64 results in NG, the image 6 to the image 8 are determined as a defective print candidate. On the other hand, when the print-prohibited region of the first face has a ejection failure monitoring pattern and when the ejection failure monitoring of the ejection failure monitoring pattern 62 results in OK and the ejection failure monitoring of the ejection failure monitoring pattern 64 results in NG, only the image 7 and the image 8 are determined as a defective print candidate. This can consequently provide an improved accuracy of the ejection failure monitoring determination.

As described above, by allowing the double-sided printing mode to use a ejection failure monitoring pattern set in a print-prohibited region also, an increased number of the ejection failure monitorings can be used without causing an increased number of the use of the sheet, thus providing an increased monitoring accuracy.

The above-described embodiment has been described based on an assumption that a unique portion mark for identifying a unique portion region of the sheet is provided in the vicinity of the front side of the unique portion region. However, the position of the mark is not limited to this. For example, the sheet top (in the vicinity of the leading end of the sheet) may include the information for the position at which each unique portion region exists (information for the length from the top of the roll paper and information for the first face/the second face) printed by a barcode for example. In this case, in the step of preparing the printing schedule of the first face, based on the position information of the read unique portion region, a plurality of unit images to be printed, a cut mark, a preliminary ejection, a ejection failure monitoring pattern, a space region and a print-prohibited region may be scheduled. In this case, the processing for updating the printing schedule based on the detection of a unique portion mark during printing is not required.

In the above embodiment, when a unique portion is sensed in the first face or the second face of the continuous sheet, the schedule is set so that the unique portion is avoided on the sheet face including the unique portion. Then, the print head maintenance is performed on at least a part of the region corresponding to the unique portion on the back face of the sheet face including the sensed unique portion. The continuous sheet used for the method for printing based on the technical concept as described above is configured so that information showing the position of the unique portion is printed in the continuous sheet itself or the package of the continuous sheet. By acquiring this information, the unique portion is sensed. Specifically, the continuous sheet itself has a characteristic.

According to the embodiment as described above, when a plurality of images are sequentially printed on both faces of the continuous sheet and even when the sheet includes a unique portion, an optimal scheduling including the print head maintenance can be performed to thereby suppress the entire sheet consumption amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169222, filed Jul. 31, 2012, which is hereby incorporated by reference herein in its entirety.

What is claimed is:

1. An apparatus for printing a plurality of images with a print head on a continuous sheet, the apparatus comprising:

a detection unit configured to detect a unique portion unsuitable for image printing that exists on the continuous sheet; and a print control unit configured to cause the print head, if the unique portion is detected in a first face or a second face of the continuous sheet, to print an image such that the image is prevented from being printed on the unique portion on a face that has the unique portion of the continuous sheet and to print a maintenance pattern for maintenance of the print head at a region corresponding to a print-prevented region including the unique portion on a back face of the face that has the unique portion of the continuous sheet, wherein if the unique portion is detected in the first face or the second face of the continuous sheet in double-sided printing, the print head does not print a maintenance pattern for a maintenance of the print head at a region corresponding to the print-prevented region including the unique portion on the face that has the unique portion of the continuous sheet.

2. The apparatus according to claim 1, wherein if the unique portion is detected in the first face of the continuous sheet, a printing schedule of the first face of the continuous sheet is changed to carry out a printing operation by preventing an image from being printed on the unique portion.

3. The apparatus according to claim 1, wherein if the unique portion is detected in the second face of the continuous sheet, a maintenance pattern for a maintenance of the print head is printed at a region corresponding to the print-prevented region including the unique portion of the second face on the first face.

4. The apparatus according to claim 1, further comprising:

a setting unit configured to set a print schedule, and updating, if the unique portion is detected on the continuous sheet, the set printing schedule so that a print-prevented region including the unique portion is formed on the face that has the unique portion of the continuous sheet.

5. The apparatus of claim 4, wherein if the unique portion is detected in the second face of the continuous sheet, the setting unit sets the printing schedule to print a maintenance pattern at a region corresponding to the print-prevented region including the unique portion of the second face on the first face.

6. The apparatus according to claim 1, further comprising the print head.

7. A method for printing a plurality of images with a print head on a continuous sheet, the method comprising:

detecting a unique portion unsuitable for image printing that exists on the continuous sheet; and causing the print head, if the unique portion is detected in a first face or a second face of the continuous sheet, to print an image such that the image is prevented from being printed on the unique portion on a face that has the unique portion of the continuous sheet and to print a maintenance pattern for maintenance of the print head at a region corresponding to a print-prevented region including the unique portion on a back face of the face that has the unique portion of the continuous sheet, wherein if the unique portion is detected in the first face or the second face of the continuous sheet in double-sided printing, the print head does not print a maintenance pattern for a maintenance of the print head at a region corresponding to the print-prevented region including the unique portion on the face that has the unique portion of the continuous sheet.

8. The method for printing according to claim 7, wherein the continuous sheet includes information recorded in advance, indicating a position of the unique portion, and wherein the unique portion is detected by acquiring the information.

9. The method for printing according to claim 8, wherein the information is recorded as a mark in the vicinity of the unique portion or is recorded in the vicinity of a leading end of the continuous sheet.

10. The method for printing according to claim 8, wherein the information is collectively recorded on a package of the continuous sheet or is collectively recorded in a memory medium attached to the package.

11. The method for printing according to claim 7, wherein the continuous sheet or a package of the continuous sheet includes recorded information indicating the position of the unique portion.

12. The method for printing according to claim 7, wherein if the unique portion is detected in the first face of the continuous sheet, a printing schedule of the first face of the continuous sheet is changed to carry out a printing operation by preventing an image from being printed on the unique portion.

13. The method for printing according to claim 7, wherein if the unique portion is detected in the second face of the continuous sheet, a maintenance pattern for a maintenance of the print head is printed at a region corresponding to the print-prevented region including the unique portion of the second face on the first face.

14. The method for printing according to claim 7, further comprising:

setting a print schedule, and updating, if the unique portion is detected on the continuous sheet, the set printing schedule so that a print-prevented region including the unique portion is formed on the face that has the unique portion of the continuous sheet.

15. The method for printing according to claim 14, wherein if the unique portion is detected in the second face of the continuous sheet, the printing schedule is reset to print a maintenance pattern at a region corresponding to the print-prevented region including the unique portion of the second face on the first face.

16. The method for printing according to claim 7, wherein the maintenance pattern includes an ejection failure monitoring pattern for monitoring ejection failure.

* * * * *